United States Patent [19]

Schultz

[11] 3,966,292

[45] June 29, 1976

[54] PHONOJACK WITH GROUNDING TAB CLAMPING MEANS

[75] Inventor: Ronald L. Schultz, Northfield, Ill.

[73] Assignee: Chromalloy-Alcon Inc., Chicago, Ill.

[22] Filed: Oct. 15, 1974

[21] Appl. No.: 514,615

[52] U.S. Cl. ..... 339/91 P; 339/177 E

[51] Int. Cl.[2] ..... H01R 13/54; H01R 17/08

[58] Field of Search ..... 339/75 R, 91 P, 143 R, 339/143 C, 177 R, 177 E, 183, 217 J, 262

[56] References Cited

UNITED STATES PATENTS

| | | | |
|---|---|---|---|
| 920,364 | 5/1909 | Messner | 339/275 R |
| 2,450,467 | 10/1948 | Clark | 339/177 E |
| 2,548,457 | 4/1951 | Wilson | 339/177 R |
| 2,877,437 | 3/1959 | Flanagan, Jr. | 339/91 P |
| 3,258,735 | 6/1966 | Valle | 339/275 R |
| 3,439,294 | 4/1969 | Flanagan et al. | 339/177 R |
| 3,694,793 | 9/1972 | Concelman | 339/91 P |

*Primary Examiner*—Roy Lake
*Assistant Examiner*—Neil Abrams
*Attorney, Agent, or Firm*—Hill, Gross, Simpson, Van Santen, Steadman, Chiara & Simpson

[57] ABSTRACT

Clamping means such as stiffly resilient gripping fingers are mounted on and about the perimeter area of the grounding shell of a phonojack assembly for thrusting plug shell finger tabs into positive electrical contact with the grounding shell. In a desirable form, the clamping means comprise stiffly resilient gripping fingers on a sleeve secured to the end portion of the grounding shell which is adapted to be secured in grounding relation to a television receiver chassis component. High frequency leakage shielding means are also provided.

9 Claims, 3 Drawing Figures

PHONOJACK WITH GROUNDING TAB CLAMPING MEANS

This invention relates in general to separable electrical connectors, and is more particularly concerned with improvements in electrical couplings commonly referred to as phonoconnectors.

As is well known in the art, phonoconnectors are widely employed in effecting electrical couplings in television, stereo and high fidelity phonograph apparatus.

An important advantage flowing from the use of phonoconnectors resides in that low cost, convenient means are provided for connecting two circuits together, or two pieces of apparatus, without requiring a soldered connection.

Conventional forms of phonoconnectors have a rather serious problem in that the pin plug shells which have a plurality of tulip tabs or fingers formed by slotting the shells to engage with the outside diameter or perimeter area of the phonojack receptacle shells for grounding contact, rely for retention upon radially inward biasing of the tabs to make the contact. However, due to inherent variables in the metal from which the pin plug shells are made, it is virtually impossible to maintain a uniform gripping diameter and tension of the fingers. If the pin plug shells are cocked slightly when coupling with the phonojack receptacles, the tabs may become deformed and retention is correspondingly diminished. Experience has shown that retention quality diminishes with each separation and recoupling. There is frequent lack of contact efficiency of the several fingers, because, in any event, they only make contact at their tips or along their side edges, and their moment arm to the bending point is quite short. Therefore, if any one or more of the tabs is distorted or deformed it may not make contact at all. Further, since the inside diameter of the pin plug shell inwardly beyond the contacting points of the tabs is generally somewhat larger than that of the mating receptacle shell, relative rocking action may occur, with resulting intermittence in electrical contact. This has caused some television manufacturers, for example, to solder the cable connecting pin plug shell assembly to the phonojack receptacle on the chassis to prevent accidental disassembly as well as to avoid intermittence.

Another problem that has been encountered is that there may be radio frequency leakage through the inner ends of the slots, generally four in number, between the finger tabs, especially on shorter forms of the tulip style pin plug shells.

It is therefore an important object of the present invention to overcome the foregoing and other disadvantages, deficiencies, inefficiencies, shortcomings and problems in electrical couplings of the phonoconnector type and to provide new and improved means on the phonojack assemblies of such connectors to assure not only positive electrical contact but also to provide radio frequency leakage shielding means.

Another object of the invention is to provide new and improved means for assuring positive electrical contact between the phonoplug shell finger tabs and the phonojack grounding shell of a phonoconnector.

A further object of the invention is to provide new and improved means for shielding phonoconnectors against high frequency leakage.

Still another object of the invention is to provide new and improved means on phonojack assemblies for not only assuring positive electrical contact of phonoplug shell finger tabs with the phonojack grounding shells, but also to prevent radio frequency leakage.

According to principles of the invention, there is provided in combination in a phonojack assembly including a tubular grounding shell fast about a dielectric support carrying a phonojack socket contact within which a phonoplug shell is receivable, the grounding shell providing a perimeter area of substantial length longitudinally slideably engageable by plug shell finger tabs pushed onto such area from one end of the area, clamping means biased toward said area for thrusting the plug shell finger tabs into protective electrical contact with the area.

Another feature of the invention resides in the provision of shielding means for preventing radio frequency leakage through the slots between the finger tabs of a phonoplug shell engaged about the grounding shell of a phonojack assembly.

Other objects, features and advantages of the invention will be readily apparent from the following description of a preferred embodiment thereof, taken in conjunction with the accompanying drawings although variations and modifications may be effected without departing from the spirit and scope of the novel concepts embodied in the disclosure, and in which.

Figure 2:
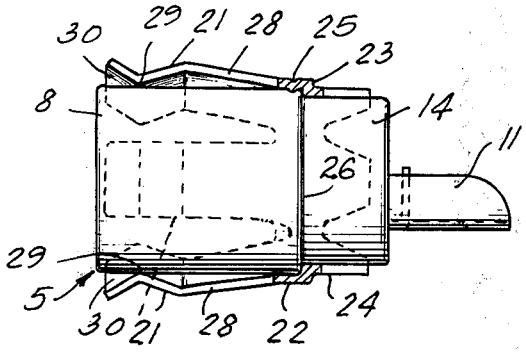
FIG. 2 is an enlarged sectional elevational view of the phonojack of the connector, taken substantially along the line II—II of FIG. 1.
Figure 3:
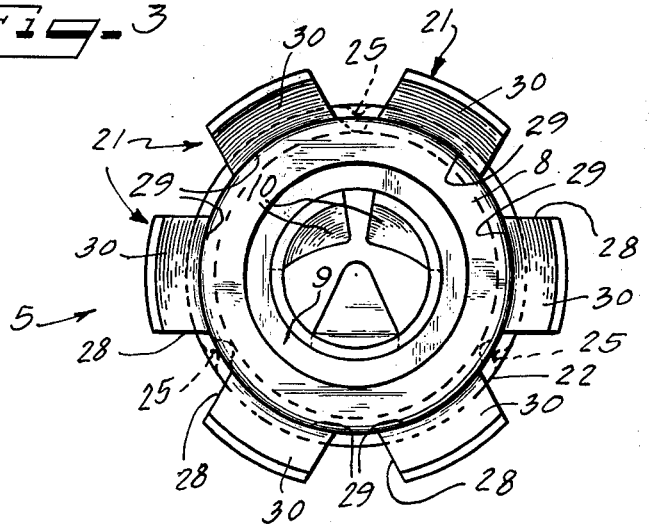
FIG. 3 is an enlarged, end elevational view of the phonojack viewed from the left or phonoplug receiving end of FIG. 2.

Phonoconnectors of the type with which the present invention is concerned comprise a receptacle or jack assembly 5 (FIGS. 1, 2 and 3) constructed and arranged to receive a mating pin plug assembly 7. Primary component elements of the jack assembly 5 comprise a tubular grounding shell 8 fast about dielectric means or insulation 9 of annular form supporting electrically conductive split sleeve receptacle socket means 10 having a rearwardly extending solder lug 11 for electrical attachment thereto as by means of soldering 12 of a terminal end portion of an insulated electrical wire or cable 13. On its rear end portion, the shell 8 has a slightly reduced diameter collar flange 14 for electrically grounding connection to a chassis component. As described up to this point, the jack assembly 5 is of any preferred, conventional construction.

Component elements of the pin plug assembly 7, which may also be of conventional construction, comprise an electrically conductive plug pin 15 dimensioned to be received in sliding frictional coaxial electrically connected relation within the socket sleeve pin. This pin 15 may be solid or hollow tubular construction, as preferred. In the pin plug assembly 7, the pin 15 is mounted concentrically on suitable dielectric mounting disks (not shown) as is conventional practice and which support the pin in insulated spaced concentric relation within an electrically conductive shell 17 by which the plug pin assembly 7 is maintained in releasably coupled relation with the phonojack receptacle 5. For this purpose, the shell 17 has a plurality, customarily four tulip fingers or tabs 18 projecting forwardly integrally thereon and of a general inside diameter to effect sliding gripping frictional electrical contact with the perimeter area of the jack shell 8. For this purpose, the tulip tabs 18 may be slightly larger diameter at their inner end portions than the diameter of the shell 8 and slightly convergently related toward their tips so as to improve the frictional grip on the shell 8. In any event, the coupling and contact tabs 18 have gaps 19 therebetween to facilitate resilient flexing of the tabs. Electrical connection with electrical apparatus may be effected with the pin 15 by means of an insulated armored electrical cable 20 which extends into the rear end of the shell 17, and which is suitably electrically connected to the pin 15 and has its armor sheath in electrically gounded connection with the shell 17 as is usual. Thereby, when the phonoplug assembly 7 is coupled with the phonojack assembly 5, a suitable electrical connection is effected between the cables 13 and 20, and a grounding connection is effected by means of the coupled shells 8 and 17.

For alleviating the problems of inadequate electrical contact between the phonoplug tabs 18 and the phonojack grounding shell 8 as well as radio frequency leakage through the slots between the tabs, clamping means are provided for thrusting the plug shell tabs 18 into positive electrical contact with the perimeter of the grounding shell and for shielding against radio frequency leakage. In a preferred example, such means comprise clamping fingers 21 desirably constructed as integral stiffly resilient elements of a shaped sheet metal sleeve 22 mounted on the phonojack shell 8. In the preferred embodiment, the sleeve 22 may be press fitted onto the rear end portion of the shell 8 and has a stepped shoulder 23 engageable against a stepped shoulder 26 between the body of the shell 8 and the reduced diameter collar flange 14. This facilitates assembly of the sleeve 22 with the shell 8 by a relative longitudinal sliding assembly motion until the shoulders 23 and 26 are engaged together, whereupon the clamping fingers 21 will be properly located about the perimeter of the shell 8 for optimum clamping engagement with the tabs 18 in the coupled engagement of the phonoconnector assemblies 5 and 7. Although means for securing the sleeve 22 to the grounding shell 8 may comprise merely press fit interengagement assisted by provision of a scalloped rearward extension 24 on the sleeve 22 about the flange 14, additional securement against axial relative displacement of the sleeve 22 from the shell 8 may be provided by means of interlocking indentations 25 at suitable circumferential intervals such as three (FIGS. 2 and 3) pressed into the sleeve 22 and in complementary relation into the rear end portion of the shell 8. Scalloping of the extension 24 facilitates crimping of the flange 14 and the scalloped extension 24 into engagement with a chassis component against which the shoulder 23 may be engaged about the perimeter of a mounting hole in the chassis component.

Each of the clamping fingers 21 is constructed and arranged to facilitate reception of the respective tabs 18 between the finger and the tab engageable perimeter area of the shell 8 and to provide optimum gripping thrust toward the engaged tab or tabs to assure thorough electrical grounding contact between the tabs 18 and the shell 8. To this end, the clamping fingers 21 are separated from one another by respective longitudinal slots 27 so that each finger will have independent resilient gripping capability, but is connected at its base integrally with the other fingers through the body of the sleeve 22 for mutual tab clamping cooperation. Each of the fingers 21 has a body portion 28 arched to a larger diameter than the sleeve 22, in this instance by means of an angular arched structure to provide clearance between the body portions 28 and the perimeter of the shell 8 greater than the thickness of the tabs 18. Adjacent to their distal ends, each of the fingers 21 is provided with a thrusting shoulder 29 which is normally biased toward engagement with the perimeter of the sleeve 8. To facilitate reception of the tabs 18, each of the finers 21 has a distal end generally radially outwardly flaring lead in cam flange 30. Not only does the arched structure of the body portions 28 of the fingers 21 provide clearance, but it also enhances the stiffly resilient spring bias of the clamping fingers 21 toward the thrusting shoulders 29. In length, the fingers 21 are desirably such that their tips may lie flush with the front end of the shell 8 or at least close to such front end, as shown. This assures that in the fully coupled relationship of the phonoconnectors 5 and 7, the fingers 21 will extend substantially to the root ends of the between-tab slots 19. To assure that the fingers 21 will substantially overlap the slots 19, a differential number of the fingers 21 relative to the tabs 18 is provided, a desirable arrangement comprising six of the fingers 21 where there are four of the tabs 18.

Figure 1:
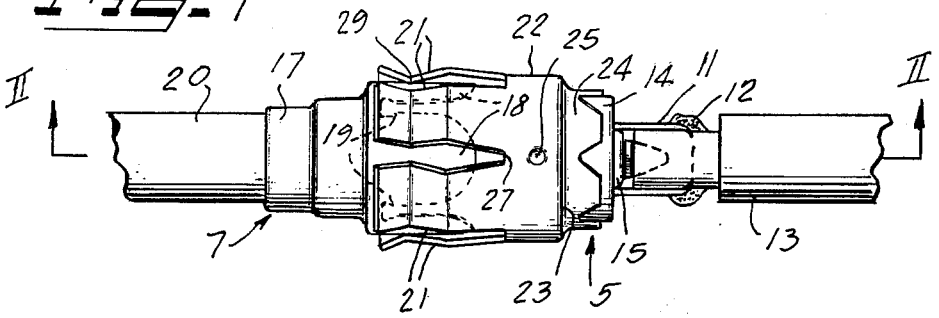
FIG. 1 is a side elevational view of a phonoconnector embodying features of the invention.

In operation, the phonoconnector assemblies 5 and 7 are adapted to be readily coupled or separated by relative axial or longitudinal movement. The phonojack assembly 5 is mounted permanently on a chassis component which may be a metal member so as to be electrically conductive for effecting a grounding connection for the phonoconnector, the collar flange 14 and the scalloped extension 24 of the sleeve 22 being crimped onto the chassis component and, if desired, soldered thereto, the scallops of the extension 24 permitting solder to enter freely therebetween and thus assuring efficiency of the soldered connection. Flaring of the scalloped extension 24 incident to permanent crimping onto the chassis component improves the clamping bias of the fingers 21. Frictional coupling of the phonoplug assembly 7 with the phonojack assembly 5 effects not only electrical contact by and between the plug pin 15 and the socket 10, but also thrusts the tabs 18 into retaining and electrical grounding gripping engagement with the perimeter area of the grounding shell 8 encompassed by the clamping fingers 21. As the tabs 18 enter between the shell 8 and the fingers 21, the tips of the tabs 18 cam along the cam flanges 30 and resiliently spread the fingers 21 sufficiently to pass the tabs 18 between the thrusting shoulders 29 and the perimeter area of the shell 8 until full coupled relationship of the assemblies 5 and 7 is attained. In this relationship, the tips of the tabs 18 extend short of the base or proximal ends of the fingers 21 as best seen in FIG. 1 and the distal end portions of the fingers 21 substantially cover the root ends of the slots 19 between the tabs 18. By reason of their stiff resilience, the fingers 21 thoroughly thrust the tabs 18 into electrical engagement with the grounding shell 8 and thus avoid any intermittency of contact between the tabs and the grounding shell, as well as preventing looseness in the connection between the coupled supporting and grounding shells 8 and 17. By reason of the larger number of clamping fingers 21 than tabs 18, there is assurance that because of the differential number of fingers 21 and between-tab slots 19, there will always be at least part of one of the fingers 21 in overlying relation to each of the slots 19, thereby at least greatly minimizing radio frequency leakage through the slots 19 and more particularly the root end portions of the slots. Since the fingers 21 are thoroughly grounded to the shell 8 and directly to the chassis component on which the phonoconnector is mounted, excellent shielding against radio frequency leakage is provided by the sleeve 22 through and by means of the fingers 21. Repeated coupling and separation of the assemblies 5 and 7 can be effected without diminishing the effectiveness and clamping and shielding efficiency of the fingers 21 and the shell 22. Further, because the fingers 21 compel the tabs 18 to be thrust into assembly with the shell 8 linearly, thus straightening out any tendency toward cocked assembly as soon as the tips of the tabs 18 encounter the lead in terminal flanges 30, there is a corresponding lineal guidance of the plug pin 15 into and through the socket 10, thereby avoiding distortions of the split sleeve socket walls, and assuring maximum retention grip of the socket on the pin and constant assurance of efficient electrical contact between the pin and socket even after repeated separation and coupling maneuvers.

It will be understood that variations and modifications may be effected without departing from the spirit and scope of the novel concepts of this invention.

I claim as my invention:

1. In combination in a phonojack assembly including a tubular grounding shell fast about a dielectric support carrying a phonojack socket contact within which a phonoplug pin is receivable, the grounding shell providing a perimeter area of substantial length longitudinally slideably engageable by plug shell tulip finger tabs pushed onto said area from one end of said area, the improvement comprising:

separate resilient clamping fingers biased toward said perimeter area for thrusting the plug shell tulip finger tabs received between said clamping fingers and said area into positive electrical contact with said area; and means fixedly secured to said grounding shell at the opposite end of said area and fixedly mounting the nearest ends of said clamping fingers.

2. A combination according to claim 1, wherein said clamping finger mounting means comprise an electrically conductive contact sleeve engaged on and about said grounding shell at said opposite end of said area and having said clamping fingers integral therewith.

3. A combination according to claim 2, wherein said grounding shell has a shoulder at said opposite end, and said sleeve has a complementary shoulder engaging the shell shoulder.

4. A combination according to claim 2, including pressed-in detents securing the sleeve to the grounding shell.

5. A combination according to claim 2, wherein said grounding shell has a mounting flange at said opposite end and said sleeve has a scalloped extension on and about said mounting flange.

6. A combination according to claim 2, wherein said fingers have body portions arched to larger diameter than the sleeve, and gripping shoulders on the distal end portions of the fingers biased toward engagement with said area of the grounding shell.

7. A combination according to claim 6, wherein said distal end portions of the fingers have lead-in cam flange terminals flaring generally radially outwardly.

8. A phonoconnector comprising a phonoplug assembly and a phonojack assembly wherein the phonoplug assembly includes a grounding shell having gripping tabs and supporting a contact pin concentrically therein, and the phonojack assembly includes a tubular grounding shell fast about a dielectric support carrying a phonojack socket within which the contact pin is receivable, the phonojack grounding shell having a perimeter area of substantial length longitudinally slideably engageable by said grounding shell gripping tabs pushed onto said perimeter area from one end of said perimeter area, the improvement comprising:

mounting means fixedly secured to said phonojack grounding shell at the opposite end of said perimeter area; and separate resilient clamping fingers fixedly attached at their nearest ends to said mounting means and biased toward said perimeter area and thrusting the plug shell tabs into positive electrical contact with said perimeter area.

9. A phonoconnector according to claim 8, wherein said tabs have separating slots therebetween, and said fingers are in a differential number to said tabs so as to overlap said slots, the fingers being electrically conductive and in electrical connection with the phonojack grounding shell so as to provide a shield against radio frequency leakage from said slots.

* * * * *